US011681248B2

(12) United States Patent
Kubo

(10) Patent No.: US 11,681,248 B2
(45) Date of Patent: Jun. 20, 2023

(54) IMAGE FORMING APPARATUS AND SHEET CONVEYANCE APPARATUS

(71) Applicant: CANON KABUSHIKI KAISHA, Tokyo (JP)

(72) Inventor: Shinji Kubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/379,825

(22) Filed: Jul. 19, 2021

(65) Prior Publication Data

US 2022/0026836 A1 Jan. 27, 2022

(30) Foreign Application Priority Data

Jul. 22, 2020 (JP) ..... JP2020-125690

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2010/0254734 A1* 10/2010 Ishioka ..... B65H 5/062 271/274

FOREIGN PATENT DOCUMENTS

| | | | | |
|---|---|---|---|---|
| JP | 2007240966 | A | 9/2007 | |
| JP | 2011059483 | A | 3/2011 | |
| JP | 2011095569 | A | 5/2011 | |
| JP | 2014157322 | A | 8/2014 | |
| WO | WO-2005071496 | A1 * | 8/2005 | ..... G03G 15/2028 |

OTHER PUBLICATIONS

WO_2005071496_A1_I Machine Translation, Japan, 2005, Tatematsu et al.*

* cited by examiner

*Primary Examiner* — Victor Verbitsky
(74) *Attorney, Agent, or Firm* — Canon U.S.A., Inc. I.P. Division

(57) ABSTRACT

An image forming apparatus includes a conveyance portion, a fixing portion including a heating portion, a guide portion, and first and second extending portions. The guide portion guides the sheet, faces a conveyance path through which the sheet passes, and is disposed at a downstream side of the fixing portion in a sheet conveyance direction. The first extending portion extends in a direction crossing a vertical direction, is disposed upstream of the guide portion, and is disposed at the fixing portion downstream side. The second extending portion extends from the first extending portion to a downstream side of the first extending portion in the conveyance direction. In a direction crossing the conveyance direction, the guide portion is disposed at one side of the conveyance path and the second extending portion is disposed to project more than the guide portion from the one side to another side of the conveyance path.

20 Claims, 7 Drawing Sheets

IMAGE FORMING APPARATUS AND SHEET CONVEYANCE APPARATUS

BACKGROUND

Field

The present disclosure relates to an image forming apparatus that forms an image on a sheet and a sheet conveyance apparatus that conveys a sheet.

Description of the Related Art

Examples of an image forming apparatus include an electrophotographic copying machine, an electrophotographic printer (a light-emitting diode (LED) printer, a laser beam printer, etc.), a facsimile apparatus, and a word processor.

Some image forming apparatuses include a fixing portion that heats a sheet on which an image is formed and fixes the image onto the sheet. When the fixing portion heats a sheet, water vapor can be generated.

Japanese Patent Application Laid-Open No. 2011-95569 discusses a configuration in which an image forming apparatus includes a sheet discharge guide for guiding a sheet that is output from a fixing unit and discharged upward, and a discharge cover provided above the sheet discharge guide, and water vapor generated from the fixing unit is discharged to the outside of the apparatus via an exhaust hole.

Water vapor generated from the fixing unit can cause a water drop to be formed on a guide portion for guiding a sheet.

SUMMARY

The present disclosure is directed towards preventing a water drop formed on a guide portion for guiding a sheet from falling onto a sheet conveyance path.

According to an aspect of the present disclosure, an image forming apparatus to form an image on a sheet using an image forming unit includes a conveyance portion configured to convey the sheet, a fixing portion including a heating portion configured to heat the sheet, a guide portion configured to guide the sheet, wherein the guide portion faces a conveyance path through which the sheet passes and is disposed at a downstream side of the fixing portion in a conveyance direction of the sheet, a first extending portion extending in a direction crossing a vertical direction, wherein the first extending portion is disposed upstream of the guide portion and is disposed at the downstream side of the fixing portion in the conveyance direction, and a second extending portion extending from the first extending portion to a downstream side of the first extending portion in the conveyance direction, wherein, in a direction crossing the conveyance direction, the guide portion is disposed at one side of the conveyance path and the second extending portion is disposed to project more than the guide portion from the one side of the conveyance path to another side of the conveyance path.

According to another aspect of the present disclosure, A sheet conveyance apparatus that conveys a sheet such that the sheet passes through a fixing portion including a heating portion includes a conveyance portion configured to convey the sheet, a guide portion configured to guide the sheet, the guide portion facing a conveyance path through which the sheet passes, the guide portion being disposed downstream of the fixing portion in a conveyance direction of the sheet, a first extending portion extending in a direction crossing a vertical direction, the first extending portion being disposed upstream of the guide portion and downstream of the fixing portion in the conveyance direction, and a second extending portion extending from the first extending portion to a downstream side of the first extending portion in the conveyance direction, wherein, in a direction crossing the conveyance direction, the guide portion is disposed at one side of the conveyance path and the second extending portion is disposed to project more than the guide portion from the one side of the conveyance path to another side of the conveyance path.

Further features of the present disclosure will become apparent from the following description of exemplary embodiments with reference to the attached drawings.

DESCRIPTION OF THE EMBODIMENTS

Modes for carrying out the present disclosure will be described in detail by way of example with reference to the drawings and exemplary embodiments. However, functions, materials, shapes, relative arrangements, and the like of components described in the exemplary embodiments are not intended to limit the scope of the disclosure unless otherwise specifically indicated.

A first exemplary embodiment of the present disclosure will be described below with reference to FIGS. 1 to 5.

Figure 1:
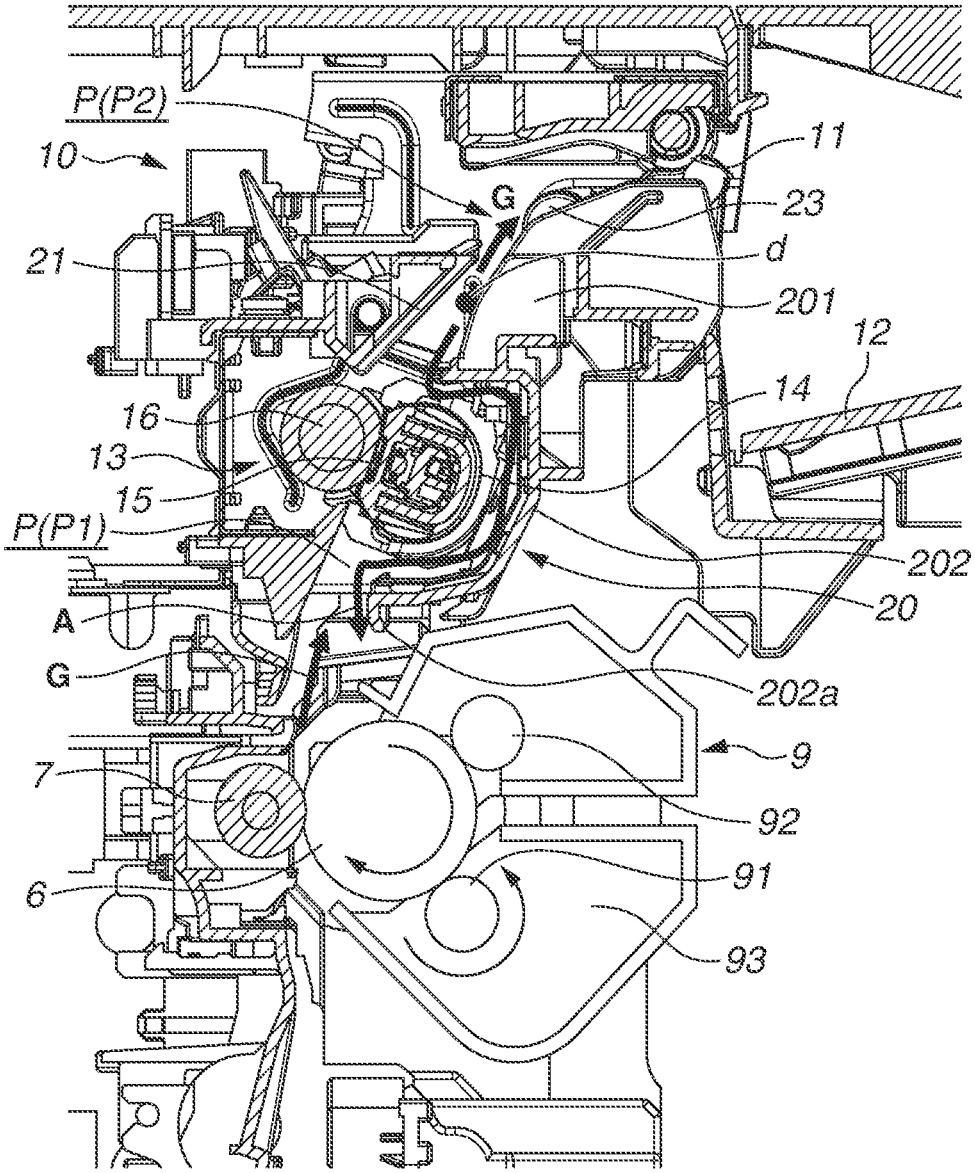
FIG. 1 is a sectional view illustrating a configuration of each of an image forming unit, a fixing unit, and a discharge unit according to a first exemplary embodiment.
Figure 2A:
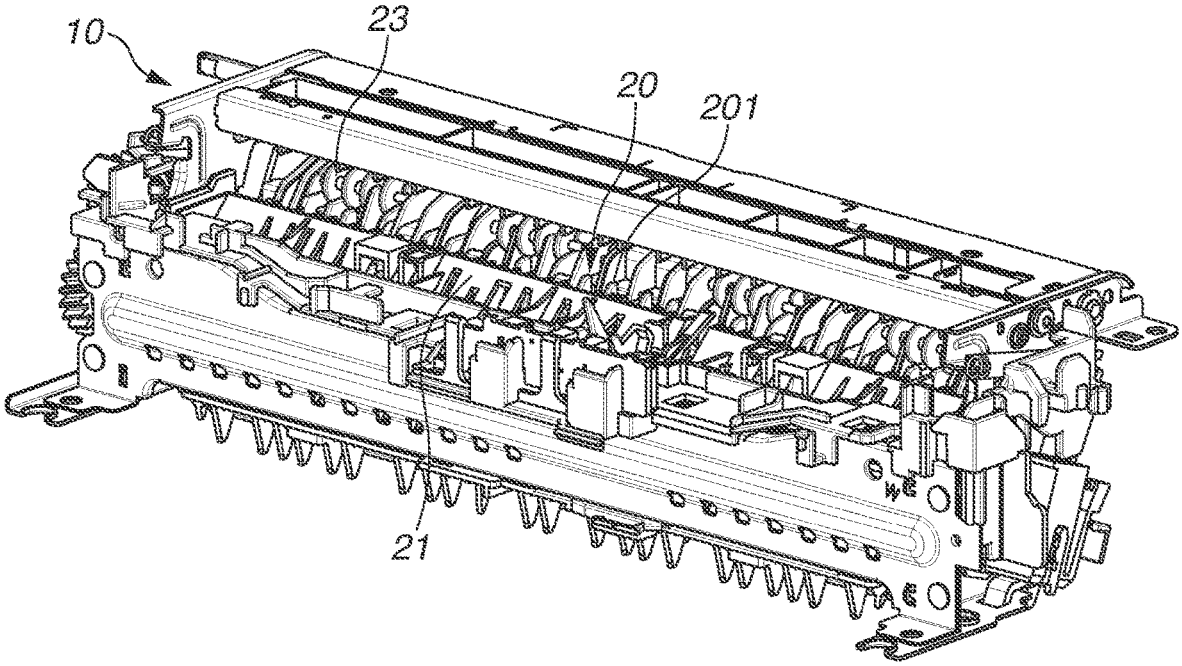
FIG. 2A is a perspective view illustrating the configuration of the fixing unit according to the first exemplary embodiment.
Figure 2B:
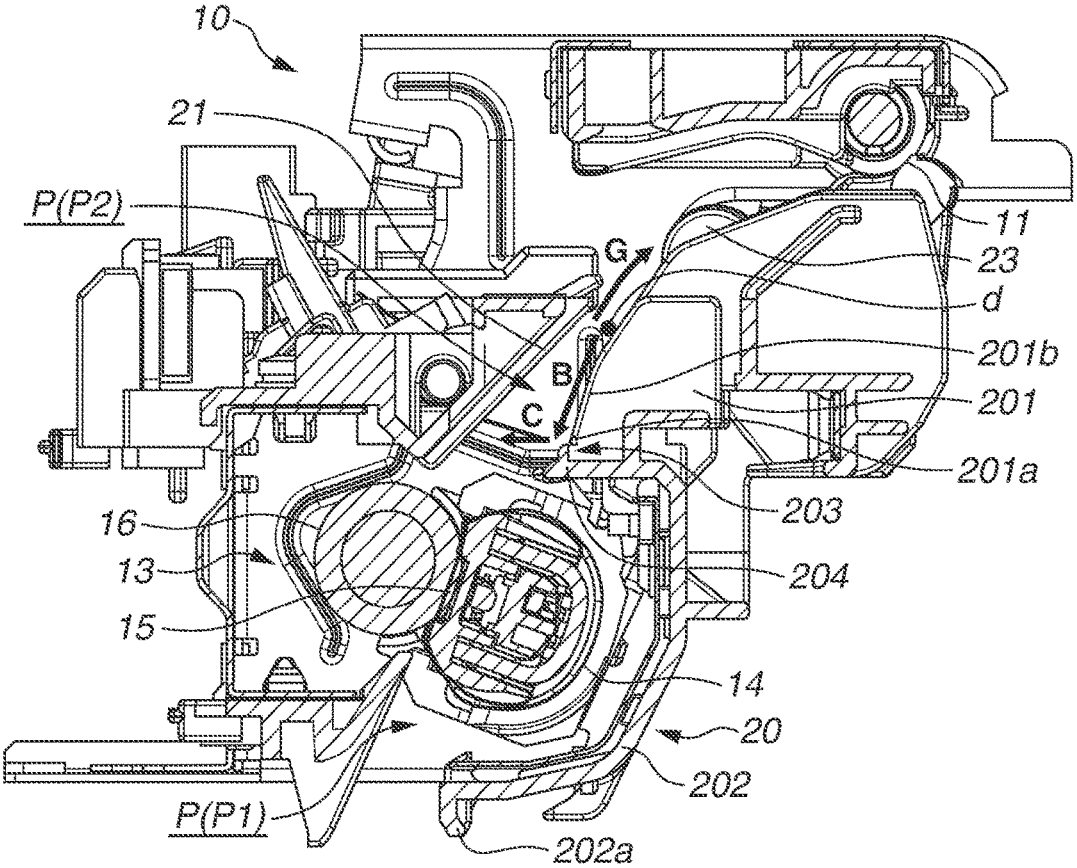
FIG. 2B is a sectional view illustrating the configuration of the fixing unit according to the first exemplary embodiment.
Figure 3:
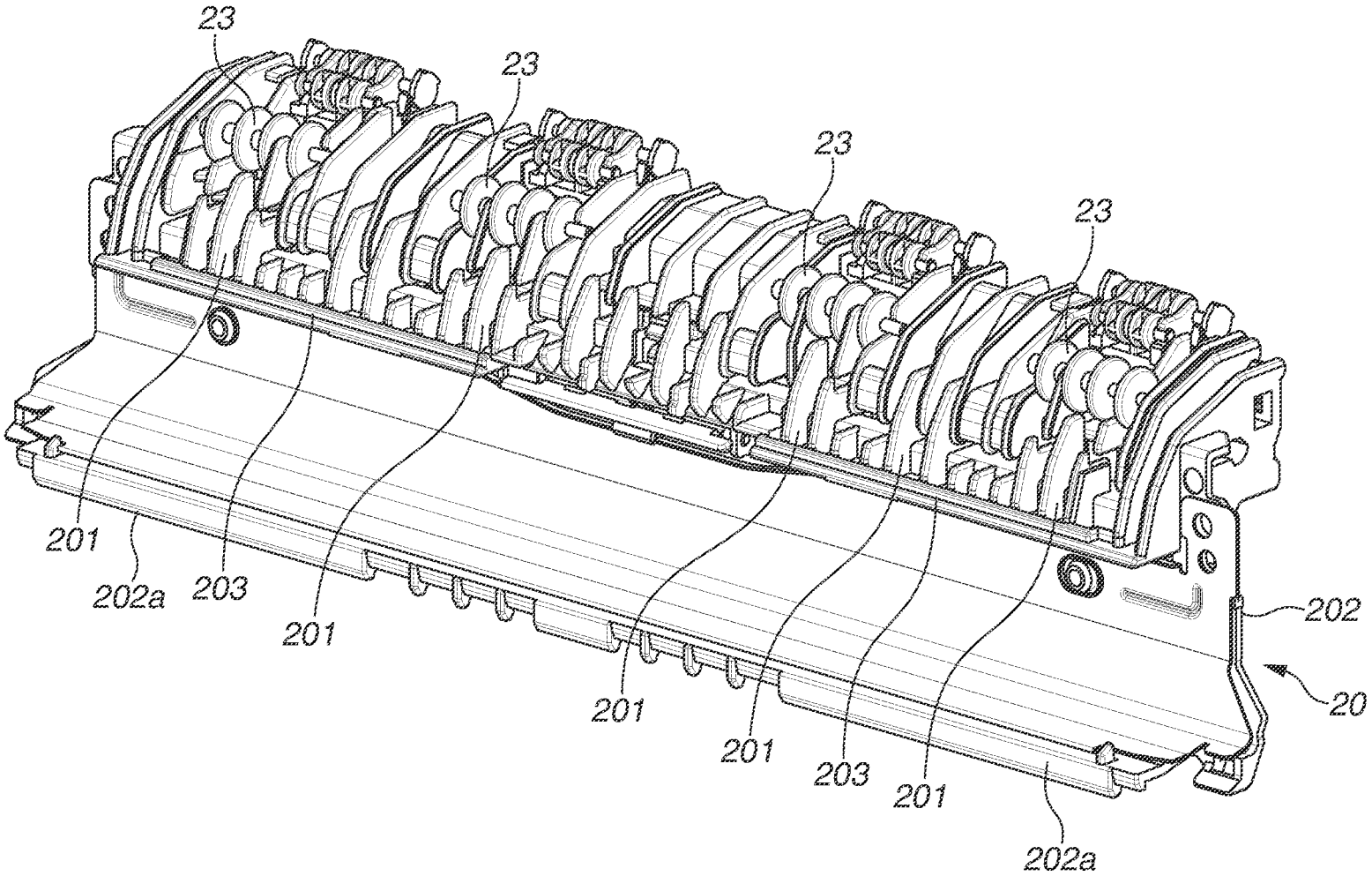
FIG. 3 is a perspective view illustrating an overall configuration of a first conveyance guide according to the first exemplary embodiment.
Figure 4A:
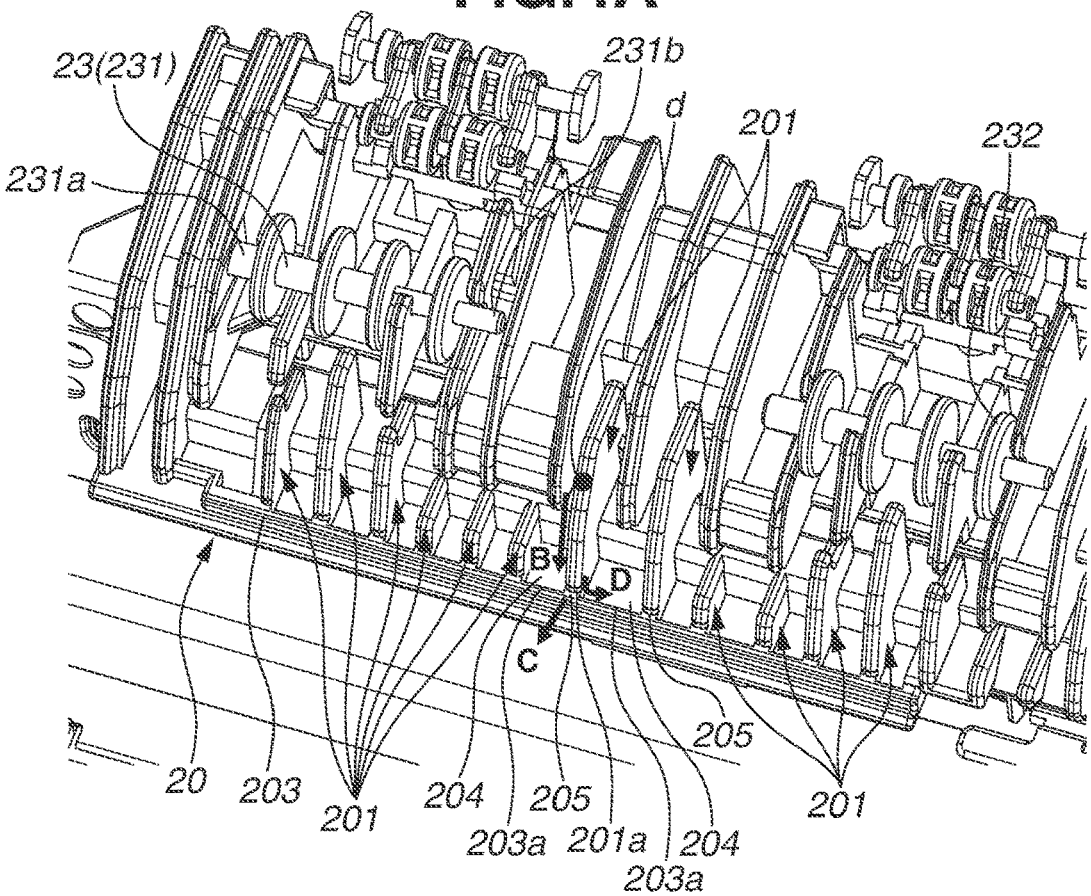
FIG. 4A is a perspective view illustrating details of the first conveyance guide according to the first exemplary embodiment.
Figure 4B:
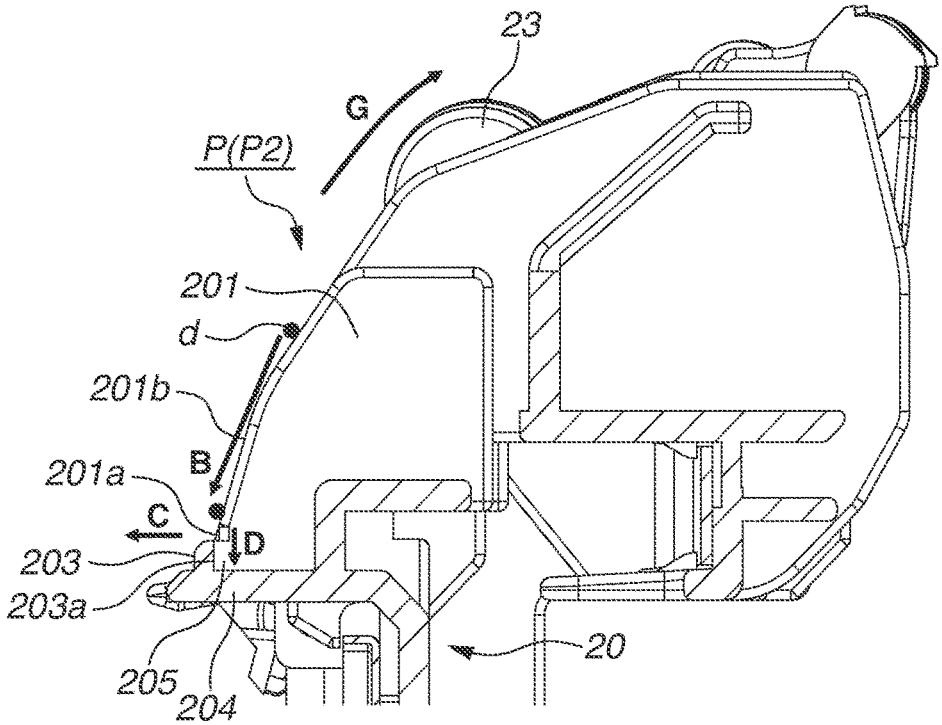
FIG. 4B is a sectional view illustrating details of the first conveyance guide according to the first exemplary embodiment.
Figure 5:
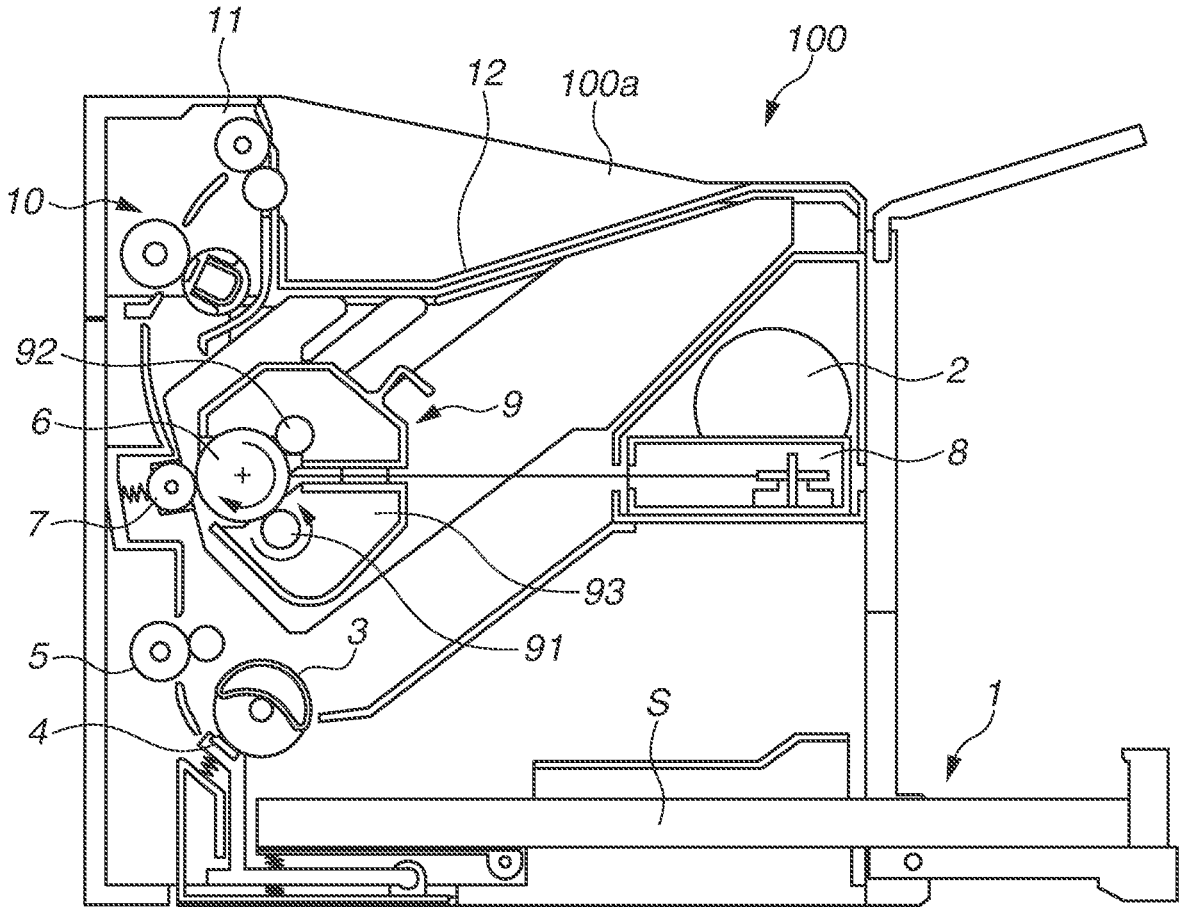
FIG. 5 is a sectional view illustrating a schematic configuration of an image forming apparatus according to an exemplary embodiment of the present disclosure.

FIG. 1 is a sectional view illustrating a configuration of each of an image forming unit, a fixing unit 10, and a discharge unit according to the first exemplary embodiment. FIGS. 2A and 2B each illustrate the configuration of the fixing unit 10 according to the first exemplary embodiment. FIG. 2A is a perspective view illustrating the configuration of the fixing unit 10 according to the first exemplary embodiment, and FIG. 2B is a sectional view illustrating the configuration of the fixing unit 10 according to the first exemplary embodiment. FIG. 3 is a perspective view illustrating an overall configuration of a first conveyance guide 20 according to the first exemplary embodiment. FIGS. 4A and 4B each illustrate details of the first conveyance guide 20 according to the first exemplary embodiment. FIG. 4A is a perspective view illustrating details of the first conveyance guide 20 according to the first exemplary embodiment, and FIG. 4B is a sectional view illustrating details of the first conveyance guide 20 according to the first exemplary embodiment. FIG. 5 is a sectional view illustrating a schematic configuration of an image forming apparatus according to an exemplary embodiment of the present disclosure.

FIGS. 1, 2B, 4B, and 5 each illustrate a laser beam printer (hereinafter referred to as a printer) 100, which is an example of the image forming apparatus, as viewed along a width direction of a sheet S to be described below. In FIGS. 1, 2B, 4B, and 5, a right-left direction indicates a horizontal direction and an up-down direction indicates a vertical direction when an image forming operation is performed on the sheet (recording material) S using the printer 100.

(Overall Configuration)

The overall configuration of the printer 100 and the image forming operation for forming an image on the sheet S will be described.

The printer 100 is an image forming apparatus that forms an image on the sheet S using the image forming unit. As illustrated in FIG. 5, an apparatus main body 100*a* of the printer 100 includes a sheet feed tray 1 on which sheets S are stacked, a drive motor 2, a feed roller 3, a separation pad 4, and a conveyance roller pair 5. The drive motor 2 drives the feed roller 3, the conveyance roller pair 5, a discharge portion 11, and the like.

When the feed roller 3 driven by the drive motor 2 is rotated, the sheet S set on the sheet feed tray 1 is sent out. Even when a plurality of sheets S is stacked on the sheet feed tray 1, the sheets S are separated one by one by the separation pad 4 and are conveyed by the conveyance roller pair 5.

The apparatus main body 100*a* includes a transfer roller 7, the fixing unit 10, a laser scanner 8 serving as an exposure device, the discharge portion 11 including a plurality of rollers, and a discharge tray 12.

In the apparatus main body 100*a*, an image carrying member (photosensitive drum) 6 and a developer carrying member (developer roller) 91 that carries developer (toner) and develops an electrostatic latent image formed on the photosensitive drum 6 with toner are provided as the image forming unit. The photosensitive drum 6 and the development roller 91 can be rotated in respective arrow directions. Further, in the apparatus main body 100*a*, a charging roller 92 serving as a charging member that charges the photosensitive drum 6 and a toner container 93 that contains toner to be supplied to the development roller 91 are provided.

In the present exemplary embodiment, the photosensitive drum 6, the development roller 91, the charging roller 92, and the toner container 93 are provided in a process cartridge 9. In other words, the process cartridge 9 includes the image forming unit. The process cartridge 9 is configured to be detachably mounted to the apparatus main body 100*a*.

Each sheet S is conveyed to a transfer nip, which is formed by the photosensitive drum 6 and the transfer roller 7, through the conveyance roller pair 5.

On the other hand, the laser scanner 8 exposes the photosensitive drum 6 charged by the charging roller 92 to light. As a result, an electrostatic latent image corresponding to an image formed on the sheet S is formed on the photosensitive drum 6.

The electrostatic latent image formed on the photosensitive drum 6 is developed by the development roller 91. Specifically, the use of toner supplied to the photosensitive drum 6 from the development roller 91 enables the electrostatic latent image formed on the photosensitive drum 6 to be visualized as a toner image.

The toner image formed on the photosensitive drum 6 is transferred onto the sheet S by the transfer nip formed of the photosensitive drum 6 and the transfer roller 7. In this state, the toner image is an unfixed image on the sheet S.

The sheet S is delivered to the fixing unit 10 and passed through a fixing portion 13 to be described below to have the toner image fixed onto the sheet S. The sheet S on which the unfixed image is formed is heated by the fixing portion 13 to fix the toner image onto the sheet S. The sheet S on which the toner image is fixed is delivered to the discharge portion 11 and is then discharged onto the discharge tray 12.

In the printer 100 according to the present exemplary embodiment, a conveyance path through which the sheet S is fed and conveyed has a C-shape. However, the shape of the conveyance path according to the present exemplary embodiment is not limited to this shape. An S-shaped conveyance path or a conveyance path with any other shape may also be used.

The feed roller 3, the conveyance roller pair 5, and the discharge portion 11 described above can be regarded as a part of a conveyance portion (sheet conveyance portion) configured to convey the sheet S. In other words, the printer 100 includes a sheet conveyance apparatus that conveys the sheet S such that the sheet S passes through the fixing portion 13 of the fixing unit 10.

(Generation of Water Drop from Fixing Unit)

Next, the generation of a water drop from the fixing unit 10 will be described with reference to FIG. 1.

The apparatus main body 100*a* of the printer 100 includes a conveyance path P. The sheet S is conveyed in a conveyance direction G by the conveyance roller pair 5, the discharge portion 11, and the like, and the sheet S passes through the conveyance path P.

As illustrated in FIG. 1, the fixing portion 13 of the fixing unit 10 includes a fixing film 14, a fixing heater 15 that heats the fixing film 14, and a pressure roller 16 that is brought into pressure contact with the fixing film 14. The fixing film 14 is heated by the fixing heater 15 and the fixing film 14 is brought into contact with the sheet S, thereby heating the sheet S. The fixing film 14 can be referred to as a heating portion configured to heat the sheet S. The conveyance path P includes an upstream conveyance path P1 located upstream of the fixing portion 13 in the conveyance direction G, and a downstream conveyance path P2 located downstream of the fixing portion 13 in the conveyance direction G.

The printer 100 includes the first conveyance guide 20 that is disposed on the outside of the fixing film 14 and covers the fixing film 14, and a second conveyance guide 21 that is disposed above the pressure roller 16. The first conveyance guide 20 and the second conveyance guide 21 are configured to guide the sheet S that has passed through the fixing portion 13. The first conveyance guide 20 and the second conveyance guide 21 guide the sheet S that has passed through the fixing portion 13 to the discharge portion 11.

The first conveyance guide 20 is disposed at a location facing a heated surface (surface to be brought into contact with the fixing film 14) of the sheet S. The second conveyance guide 21 is disposed at a location facing the back side of the heated surface. The heated surface of the sheet S is the same as a printed surface (surface on which an image is formed by the image forming unit) of the sheet S. A part of the downstream conveyance path P2 is formed between the first conveyance guide 20 and the second conveyance guide 21.

Auxiliary rollers 23 are disposed between the discharge portion 11 and the fixing portion 13. The auxiliary rollers 23 are rotated by being brought into contact with the printed surface of the sheet S conveyed in the conveyance direction G. The auxiliary rollers 23 are rotated clockwise in FIG. 1.

In the present exemplary embodiment, the plurality of auxiliary rollers 23 is disposed side by side in the width direction of the sheet S to be described below (see FIGS. 3 and 4A). In the width direction of the sheet S, an auxiliary roller 231 that is disposed on the outermost side includes a supported portion 231*a* located on the outside in the width direction and a supported portion 231*b* located on the inside in the width direction. In a rotational direction of the auxiliary roller 231, the perimeter of the supported portion 231*a* is supported and a part of the supported portion 231*b* is supported. In the width direction of the sheet S, an end of the sheet S and the auxiliary roller 231 are disposed in an overlapping manner. Only a part of an auxiliary roller 232 that is disposed on the inside in the width direction of the sheet S is supported in the rotational direction of the auxiliary roller 232.

The configuration for supporting the auxiliary roller 23 disposed at the opposite end in the width direction of the sheet S is similar to the configuration for supporting the auxiliary roller 231 described above, and thus the description thereof is omitted.

The first conveyance guide (guide member, first guide member) 20 includes guide ribs (guide portion) 201 configured to guide the sheet S. The guide ribs 201 are disposed downstream of the fixing portion 13 in the conveyance direction G. The guide ribs 201 are disposed above the fixing film 14.

The first conveyance guide 20 further includes a cover portion (third extending portion) 202 that covers the fixing film 14. The cover portion 202 is disposed with a gap formed between the cover portion 202 and the fixing film 14. The cover portion 202 extends from the downstream side to the upstream side of the fixing film 14 in the conveyance direction G, and includes an end 202*a*. The end 202*a* faces the upstream conveyance path P1. The end 202*a* is disposed upstream of the fixing film 14 in the conveyance direction G, and is located above the photosensitive drum 6. In the present exemplary embodiment, the end 202*a* is located immediately above the photosensitive drum 6. In other words, in the horizontal direction, the position of the end 202*a* and the position of the photosensitive drum 6 overlap each other. An opposed surface of the cover portion 202 that is opposed to the fixing film 14 is continuously formed from the downstream side to the upstream side of the fixing film 14.

Each guide rib 201 is a plate-shaped member that extends in a direction crossing the width direction of the sheet S and faces the downstream conveyance path P2 of the conveyance path P. Specifically, as described below, each guide rib 201 includes a sheet guide surface (guide surface) 201*b*, and the guide surface 201*b* faces the downstream conveyance path P2 in the conveyance path P.

When the sheet S passes through the fixing portion 13, the sheet S is heated and moisture contained in the sheet S is evaporated, so that water vapor is generated. The water vapor causes condensation on each guide rib 201 of the first conveyance guide 20, and a water drop d is formed on the guide rib 201.

When the water drop d formed on the guide rib 201 falls onto the conveyance path P, the water drop d can attach to the fixing film 14. Further, when the water drop d formed on the guide rib 201 moves down to the guide rib 201 as indicated by an arrow A and falls down from the end 202*a* via the cover portion 202, the water drop d can attach to the photosensitive drum 6. When the water drop d is attaches to the photosensitive drum 6, an image is not formed at a location where the water drop d is attached, so that the image can be impaired.

(Prevention of Falling of Water Drop)

A configuration for preventing the water drop d formed due to water vapor generated from the fixing unit 10 from falling onto the conveyance path P will be described with reference to FIGS. 2A, 2B, 3, 4A, and 4B.

As illustrated in FIGS. 2A, 3, and 4A, in the first conveyance guide 20, the plurality of guide ribs 201 is disposed side by side in the width direction of the sheet S.

The width direction of the sheet S corresponds to the conveyance direction G and the direction orthogonal to the thickness direction of the sheet S. The width direction of the sheet S coincides with the rotational axis direction of each of the rollers of the conveyance roller pair 5 and the discharge portion 11 and with the rotational axis direction of each of the auxiliary rollers 23. In the present exemplary embodiment, the rotational axis direction of the fixing film 14, the rotational axis direction of the pressure roller 16, the rotational axis direction of the photosensitive drum 6, the rotational axis direction of the development roller 91, the rotational axis direction of the transfer roller 7, and the rotational axis direction of the feed roller 3 are parallel to the width direction of the sheet S.

As illustrated in FIGS. 2B, 3, 4A, and 4B, a receiving portion (first extending portion) 204 and a water drop regulation portion (second extending portion) 203 are disposed at a lower end of each guide rib 201. The receiving portion 204 and the water drop regulation portion 203 extend in the direction crossing the direction in which each guide rib 201 extends (orthogonal direction in the present exemplary embodiment). As described below, the receiving portion 204 and the water drop regulation portion 203 are disposed to project more than each guide rib 201 toward the conveyance path P (downstream conveyance path P2) in the direction crossing the conveyance direction G.

As illustrated in FIG. 4A, the water drop regulation portion 203 has a shape in which the plurality of guide ribs 201 is coupled via a coupling portion 205 to be described below. Specifically, the water drop regulation portion 203 couples the adjacent guide ribs 201 via the coupling portion 205 to be described below. The receiving portion 204 is located between the adjacent guide ribs 201.

The guide ribs 201 are disposed such that the sheet S passes above the guide ribs 201. Each guide rib 201 includes the guide surface 201*b* for guiding the sheet S. The guide surface 201*b* of each guide rib 201 is disposed to be opposed to the conveyance path P (downstream conveyance path P2) and to be opposed to the heated surface of the sheet S. The sheet S is conveyed in contact with the guide surface 201*b*. The guide surface 201*b* is a surface that faces upward in the vertical direction. Each guide rib 201 further includes an upstream surface 201*a* at an upstream end in the conveyance direction G. The upstream surface 201*a* is disposed upstream of the guide surface 201*b*, and is opposed to the conveyance path P (downstream conveyance path P2). The upstream surface 201*a* is disposed at a lower end of the guide rib 201 in the vertical direction.

The upstream surface 201*a* can also be referred to as a surface disposed at an upstream end in the conveyance direction G in the surface of each guide rib 201 that is opposed to the downstream conveyance path P2. The upstream surface 201*a* can also be referred to as a surface disposed at a lower end in the vertical direction in the surface of each guide rib 201 that is opposed to the downstream conveyance path P2.

As illustrated in FIGS. 2B and 4B, the receiving portion 204 is disposed at the upstream side of each guide rib 201 and at the downstream side of the fixing portion 13 and the fixing film 14 in the conveyance direction G. The receiving portion 204 is disposed below each guide ribs 201 in the vertical direction. In the present exemplary embodiment, a part of the receiving portion 204 is disposed immediately below the upstream surface 201*a*. Specifically, in the horizontal direction, the position of the upstream surface 201*a* and the position of the receiving portion 204 overlap each other. A part of the receiving portion 204 is disposed immediately below the guide surface 201*b*. Specifically, in the horizontal direction, the position of the guide surface 201*b* and the position of the receiving portion 204 overlap each other.

The receiving portion 204 extends in the direction crossing the vertical direction (up-down direction in the drawings), and the receiving portion 204 can receive the water drop d falling down from each guide rib 201. In the present exemplary embodiment, the receiving portion 204 extends in the horizontal direction. Each guide rib 201 extends upward as viewed from the receiving portion 204.

The receiving portion 204 projects more than each guide ribs 201 toward the downstream conveyance path P2 (toward the conveyance path) in the direction crossing the conveyance direction G. The receiving portion 204 projects more than each guide rib 201 toward the downstream conveyance path P2 (toward the conveyance path) in the direction crossing the vertical direction (more preferably, in the horizontal direction). The receiving portion 204 is disposed to partition each guide rib 201 and the fixing film 14.

As illustrated in FIGS. 2B and 4B, the water drop regulation portion 203 has a convex shape projecting toward the downstream conveyance path P2 (toward the conveyance path) in the conveyance path P with respect to each guide rib 201.

As illustrated in FIGS. 2B and 4B, the water drop regulation portion 203 extends from the receiving portion 204 toward the downstream side of the receiving portion 204 in the conveyance direction G. The water drop regulation portion 203 is located below the guide surface 201*b* of each guide rib 201. In the present exemplary embodiment, the water drop regulation portion 203 extends upward in the vertical direction from the receiving portion 204. The water drop regulation portion 203 regulates the movement of the water drop d falling down from each guide rib 201 and the water drop d received by the receiving portion 204 to the conveyance path P (downstream conveyance path P2).

The water drop regulation portion 203 includes a regulation surface 203*a*. The regulation surface 203*a* is disposed to face the opposite side of the conveyance path P (downstream conveyance path P2) in the direction crossing the conveyance direction G. In other words, in the direction crossing the conveyance direction G, the conveyance path P (downstream conveyance path P2) is located on the back side of the regulation surface 203*a*.

As described above, the water drop regulation portion 203 is disposed at a location where the water drop regulation portion 203 projects more than each guide rib 201 toward the conveyance path P (downstream conveyance path P2) (toward the conveyance path) in the direction crossing the conveyance direction G. The water drop regulation portion 203 is disposed to project more than each guide rib 201 toward the conveyance path P (downstream conveyance path P2) in the direction crossing the vertical direction (more preferably, in the horizontal direction).

In the present exemplary embodiment, the water drop regulation portion 203 is disposed to project more than the upstream surface 201*a* toward the conveyance path P (downstream conveyance path P2). Further, in the present exemplary embodiment, the regulation surface 203*a* of the water drop regulation portion 203 is also disposed to project more than the upstream surface 201*a* toward the conveyance path P (downstream conveyance path P2).

In the direction crossing the conveyance direction G, each guide rib 201 is disposed at one side of the conveyance path P (downstream conveyance path P2). The second conveyance guide 21 is disposed at the other side (opposite side of the one side) of the conveyance path P (downstream conveyance path P2). The second conveyance guide (conveyance path cover member) 21 is disposed to cover the conveyance path P (downstream conveyance path P2). The conveyance path P (downstream conveyance path P2) is formed between each guide rib 201 and the second conveyance guide 21.

In the present exemplary embodiment, the water drop regulation portion 203 is disposed to project more than each guide rib 201 from one side to the other side of the conveyance path P (downstream conveyance path P2) in the direction crossing the conveyance direction G. In the direction crossing the vertical direction (preferably, in the horizontal direction), the water drop regulation portion 203 is disposed to project more than each guide rib 201 from one side to the other side of the conveyance path P (downstream conveyance path P2). In the present exemplary embodiment, the water drop regulation portion 203 is disposed to project more than the upstream surface 201*a* from one side to the other side of the conveyance path P (downstream conveyance path P2) in each direction (in the direction crossing the conveyance direction G, in the direction crossing the vertical direction, and in the horizontal direction).

In the present exemplary embodiment, the receiving portion 204 is disposed to project more than each guide rib 201 from one side to the other side of the conveyance path P (downstream conveyance path P2) in the direction crossing the conveyance direction G. Further, in the direction crossing the vertical direction (preferably, in the horizontal direction), the receiving portion 204 is disposed to project more than each guide rib 201 from one side to the other side of the conveyance path P (downstream conveyance path P2). In the present exemplary embodiment, the receiving portion 204 is disposed to project more than the upstream surface 201*a* from one side to the other side of the conveyance path P (downstream conveyance path P2) in each direction (in the direction crossing the conveyance direction G, in the direction crossing the vertical direction, and in the horizontal direction).

In the present exemplary embodiment, the coupling portion 205 that couples the water drop regulation portion 203 and each guide rib 201 is disposed as illustrated in FIGS. 4A and 4B.

Water vapor generated from the fixing unit 10 causes the water drop d to be formed on the guide surface 201*b* of each guide rib 201. The water drop d falls down in a direction indicated by an arrow B along the guide surface 201*b* due to a gravitational force. The water drop d that has fallen down to an end of each guide rib 201 contacts the coupling portion 205 and moves in a direction indicated by an arrow D. The water drop d that has moved in the direction indicated by the arrow D is received by the receiving portion 204 and the movement of the water drop d toward the conveyance path P (downstream conveyance path P2) in a direction indicated by an arrow C is regulated by the regulation surface 203*a* of the water drop regulation portion 203.

As a result, even when the water vapor generated from the fixing unit 10 causes the water drop d to be formed on the guide rib 201, it is possible to prevent the water drop d from falling onto the conveyance path P. It is also possible to prevent the water drop d from falling onto the photosensitive drum 6 through the cover portion 202.

In the present exemplary embodiment, the water drop regulation portion 203, the guide ribs 201, the receiving portion 204, and the cover portion 202 are integrally formed in the first conveyance guide 20. However, the present disclosure is not limited to this configuration. These portions may be made using different members, and the portions may be combined. For example, the water drop regulation portion 203 may be made using a member different from that of the first conveyance guide 20.

Next, a second exemplary embodiment of the present disclosure will be described with reference to FIGS. 6A and 6B.

In the second exemplary embodiment, descriptions of items common to those of the first exemplary embodiment are omitted. Components similar to those described in the first exemplary embodiment are denoted by the same reference numerals, and the descriptions thereof are omitted.

Figure 6A:
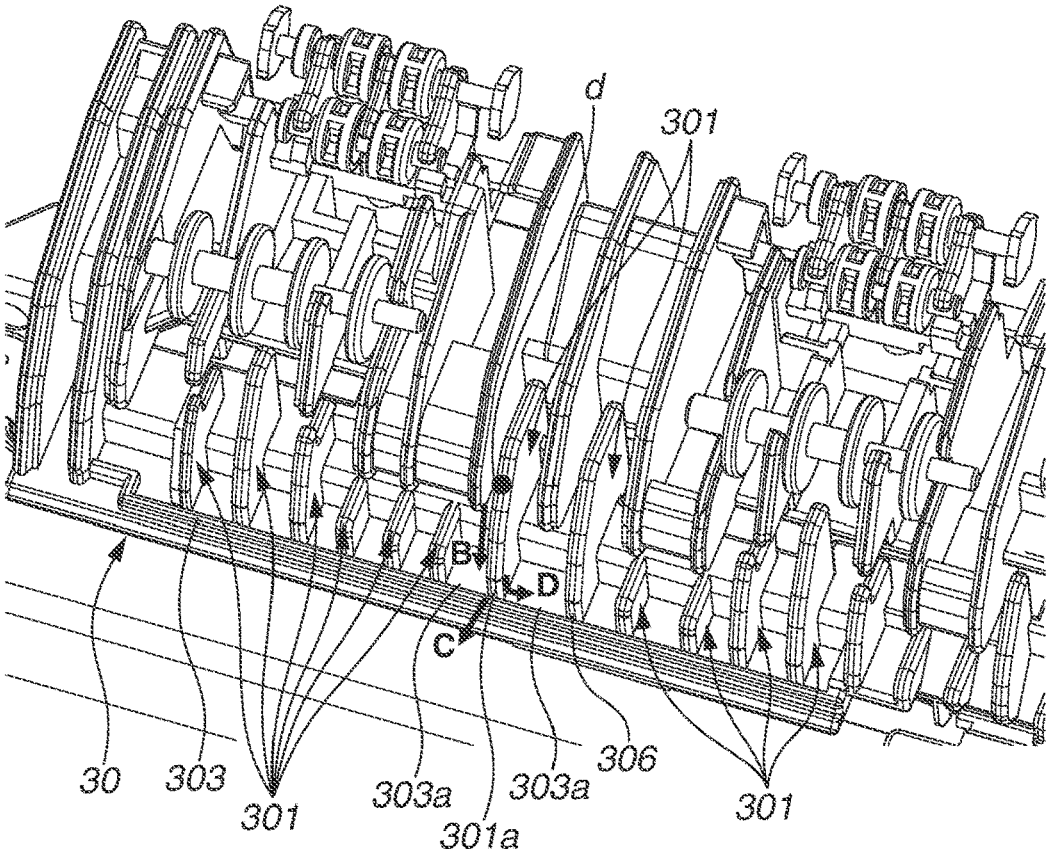
FIG. 6A is a perspective view illustrating details of a first conveyance guide according to a second exemplary embodiment.
Figure 6B:
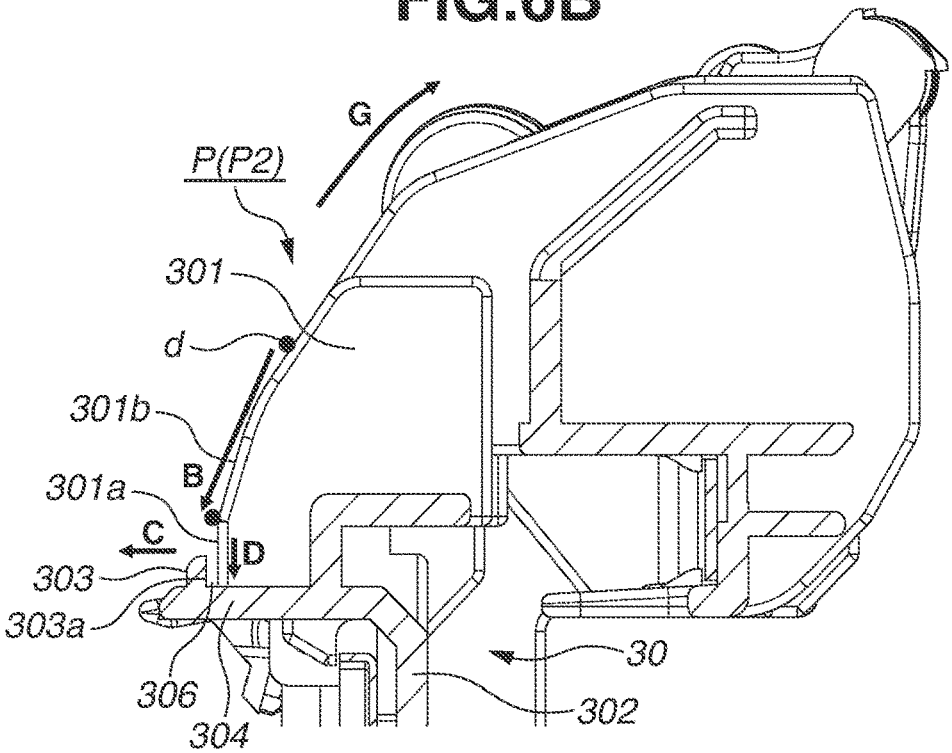
FIG. 6B is a sectional view illustrating details of the first conveyance guide according to the second exemplary embodiment.

FIGS. 6A and 6B each illustrate details of a first conveyance guide 30 according to the second exemplary embodiment. FIG. 6A is a perspective view illustrating details of the first conveyance guide 30 according to the second exemplary embodiment. FIG. 6B is a sectional view illustrating details of the first conveyance guide 30 according to the second exemplary embodiment. FIG. 6B is depicted from the same point of view as in FIG. 4B, and the definitions of the right-left direction and the up-down direction in FIG. 6B are the same as those in FIG. 4B.

The printer 100 according to the present exemplary embodiment includes the first conveyance guide 30 in place of the first conveyance guide 20 according to the first exemplary embodiment. The first conveyance guide 30 has a configuration in which the shape of the first conveyance guide 20 is partially changed.

The first conveyance guide 30 includes guide ribs 301 corresponding to the guide ribs 201, a cover portion 302 corresponding to the cover portion 202, a water drop regulation portion 303 corresponding to the water drop regulation portion 203, and a receiving portion 304 corresponding to the receiving portion 204. Each guide rib 301 includes a guide surface 301*b* corresponding to the guide surface 201*b*. The water drop regulation portion 303 includes a regulation surface 303*a* corresponding to the regulation surface 203*a*. Like the guide ribs 201 according to the first exemplary embodiment, the plurality of guide ribs 301 is disposed in the width direction of the sheet S. These configurations are similar to those described in the first exemplary embodiment.

In the first conveyance guide 30, the relationship between the water drop regulation portion 303 and each guide rib 301 is different from the relationship between the water drop regulation portion 203 and each guide rib 201 in the first conveyance guide 20.

In the first exemplary embodiment, the water drop regulation portion 203 and each guide rib 201 are coupled by the coupling portion 205. In the present exemplary embodiment, the water drop regulation portion 303 and each guide rib 301 are disposed with a gap formed between the water drop regulation portion 303 and each guide rib 301.

Specifically, each guide rib 301 also includes an upstream surface 301*a* at an upstream end in the conveyance direction G. The upstream surface 301*a* is connected to the receiving portion 304.

Like in the first exemplary embodiment, the upstream surface 301*a* can also be referred to as a surface disposed at an upstream end in the conveyance direction G in the surface of each guide rib 301 that is opposed to the downstream conveyance path P2. The upstream surface 301*a* can also be referred to as a surface disposed at a lower end in the vertical direction in the surface of each guide rib 301 that is opposed to the downstream conveyance path P2.

The regulation surface 303*a* of the water drop regulation portion 303 and the upstream surface 301*a* at a lower end of each guide rib 301 form a groove portion 306. In other words, the regulation surface 303*a* and the upstream surface 301*a* are opposed to each other with a gap formed therebetween.

Like in the first exemplary embodiment, the water vapor generated from the fixing unit 10 causes the water drop d to be formed on the guide surface 301*b* of each guide rib 301. The water drop d falls down in the direction indicated by the arrow B along the guide surface 301*b* due to the gravitational force. The water drop d moves in the direction indicated by the arrow D along the upstream surface 301*a*. The water drop d that has moved in the direction indicated by the arrow D is received by the receiving portion 304 and the movement of the water drop d toward the conveyance path P (downstream conveyance path P2) in the direction indicated by the arrow C is regulated by the regulation surface 303*a* of the water drop regulation portion 303.

The presence of the groove portion 306 further prevents the movement of the water drop d toward the conveyance path P (downstream conveyance path P2) in the direction indicated by the arrow C.

Next, a third exemplary embodiment of the present disclosure will be described with reference to FIGS. 7A and 7B.

In the third exemplary embodiment, descriptions of items common to those of the first exemplary embodiment are omitted. Components similar to those described in the other exemplary embodiments are denoted by the same reference numerals, and the descriptions thereof are omitted.

Figure 7A:
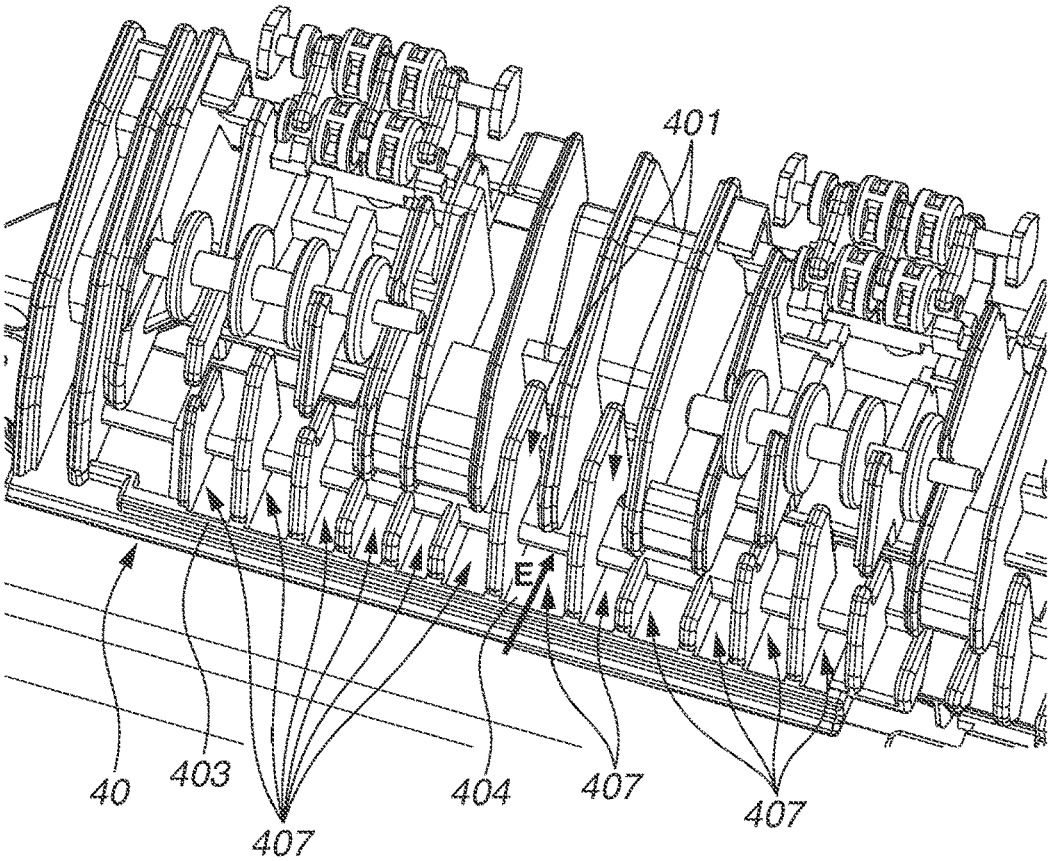
FIG. 7A is a perspective view illustrating details of a first conveyance guide according to a third exemplary embodiment.
Figure 7B:
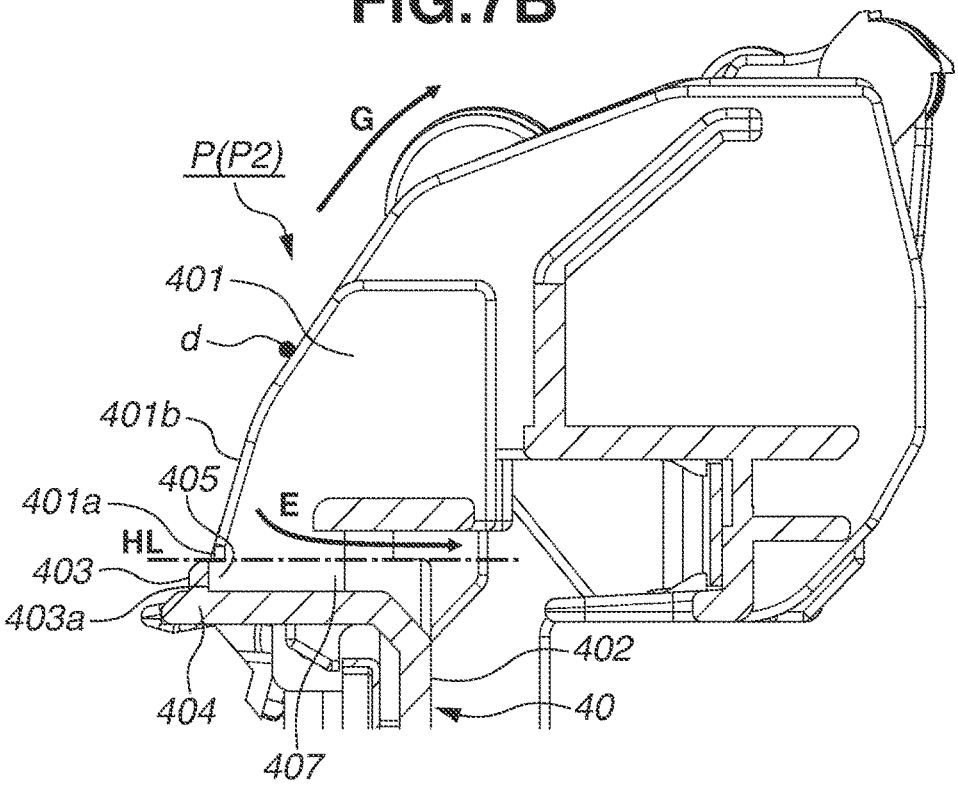
FIG. 7B is a sectional view illustrating details of the first conveyance path according to the third exemplary embodiment.

FIGS. 7A and 7B each illustrate details of a first conveyance guide 40 according to the third exemplary embodiment. FIG. 7A is a perspective view illustrating details of the first conveyance guide 40 according to the third exemplary embodiment, and FIG. 7B is a sectional view illustrating details of the first conveyance guide 40 according to the third exemplary embodiment. FIG. 7B is depicted from the same point of view as in FIG. 4B, and the definitions of the right-left direction and the up-down direction in FIG. 7B are the same as those in FIG. 4B.

The printer 100 according to the present exemplary embodiment includes the first conveyance guide 40 in place of the first conveyance guide 20 according to the first exemplary embodiment. The first conveyance guide 40 has a configuration in which the shape of the first conveyance guide 20 is partially changed.

The first conveyance guide 40 includes guide ribs 401 corresponding to the guide ribs 201, a cover portion 402 corresponding to the cover portion 202, a water drop regulation portion 403 corresponding to the water drop regulation portion 203, a receiving portion 404 corresponding to the receiving portion 204, and a coupling portion 405 corresponding to the coupling portion 205. Each guide rib 401 includes an upstream surface 401*a* corresponding to the upstream surface 201*a*, and a guide surface 401*b* corresponding to the guide surface 201*b*. The water drop regulation portion 403 includes a regulation surface 403*a* corresponding to the regulation surface 203*a*. Like the guide ribs 201 according to the first exemplary embodiment, the plurality of guide ribs 401 is disposed in the width direction of the sheet S. These configurations are similar to those described in the first exemplary embodiment. The first conveyance guide 40 may include the groove portion 306 according to the second exemplary embodiment in place of the coupling portion 405.

As illustrated in FIG. 7A, the first conveyance guide 40 includes the plurality of guide ribs 401. Each guide rib 401 further includes an exhaust hole (opening, through-hole) 407. The exhaust hole 407 is disposed between the adjacent guide ribs 401. The exhaust hole 407 is disposed above the receiving portion 404.

More specifically, as illustrated in FIG. 7B, the exhaust hole 407 communicates with a space formed by the plurality of guide ribs 401, the receiving portion 404, and the water drop regulation portion 403. The exhaust hole 407 is opposed to the regulation surface 403*a* of the water drop regulation portion 403. The exhaust hole 407 is disposed such that the exhaust hole 407 overlaps a horizontal line HL passing through an upper end in the vertical direction of the water drop regulation portion 403. A lower end of the exhaust hole 407 is formed at a position lower than the horizontal line HL. An upper end of the exhaust hole 407 is formed at a position higher than the horizontal line HL.

The water vapor generated from the fixing unit 10 passes through the exhaust hole 407 and is then discharged to the opposite side of the downstream conveyance path P2. More specifically, the water vapor generated from the fixing unit 10 is discharged from the exhaust hole 407 in a direction indicated by an arrow E, and the water vapor passes through the outside of the fixing unit 10 and the discharge tray 12 and is then discharged to the outside of the apparatus main body 100*a*. Accordingly, the printer 100 according to the present exemplary embodiment can reduce the water drop d to be formed on each guide rib 401, compared with the printer 100 according to the first exemplary embodiment. Consequently, it is possible to further prevent the water drop d from falling onto the conveyance path P.

Further, a drop falling prevention portion that prevents the water drop d from falling down may be provided on the outside of the cover portion 402 of the first conveyance guide 40 or in the vicinity of an outlet of the exhaust hole 407. This configuration makes it possible to prevent the water drop d output from the exhaust hole 407 from falling onto the process cartridge 9.

The configurations described above in the exemplary embodiments can be arbitrarily combined as needed.

The configuration including the conveyance portion and the first conveyance guides 20, 30, and 40 described above can also be referred to as a sheet conveyance apparatus that conveys the sheet S such that the sheet S passes through the fixing portion 13 having the fixing film 14. The sheet conveyance apparatus may include a member other than the first conveyance guides 20, 30, and 40, such as the second conveyance guide 21.

As described above, according to an exemplary embodiment of the present disclosure, it is possible to prevent a water drop formed on the guide portion for guiding a sheet from falling onto the conveyance path of the sheet.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-125690, filed Jul. 22, 2020, which is hereby incorporated by reference herein in its entirety.

What is claimed is:

1. An image forming apparatus to form an image on a sheet using an image forming unit, the image forming apparatus comprising:

a conveyance portion configured to convey the sheet;

a fixing portion including a heating portion configured to heat the sheet;

a guide portion configured to guide the sheet, wherein the guide portion faces a conveyance path through which the sheet passes, and the guide portion is disposed above the heating portion and is disposed at a downstream side of the fixing portion in a conveyance direction of the sheet;

a first extending portion extending in a direction crossing a vertical direction, wherein the first extending portion is disposed upstream of the guide portion and is disposed at the downstream side of the fixing portion in the conveyance direction; and a second extending portion extending from the first extending portion to a downstream side of the first extending portion in the conveyance direction, wherein, in a direction crossing the conveyance direction, the guide portion is disposed at one side of the conveyance path and the second extending portion is disposed to project more than the guide portion from the one side of the conveyance path to another side of the conveyance path, wherein, in a horizontal direction, the first extending portion is disposed to project more than the guide portion from the one side of the conveyance path to the other side of the conveyance path, and wherein, in the horizontal direction, the second extending portion is disposed to project more than the guide portion from the one side of the conveyance path to the other side of the conveyance path.

2. The image forming apparatus according to claim 1, wherein the first extending portion is configured to receive a water drop falling down from the guide portion and the second extending portion includes a regulation surface configured to regulate a movement of the water drop received by the first extending portion, and wherein the regulation surface faces an opposite side of the conveyance path in the direction crossing the conveyance direction.

3. The image forming apparatus according to claim 1, wherein, in the vertical direction, the first extending portion is disposed below the guide portion.

4. The image forming apparatus according to claim 3, wherein, in the vertical direction, the second extending portion extends upward from the first extending portion.

5. The image forming apparatus according to claim 1, wherein, in the direction crossing the vertical direction, the first extending portion is disposed to project more than the guide portion from the one side of the conveyance path to the other side of the conveyance path.

6. The image forming apparatus according to claim 1, wherein, in the direction crossing the vertical direction, the second extending portion is disposed to project more than the guide portion from the one side of the conveyance path to the other side of the conveyance path.

7. The image forming apparatus according to claim 1, wherein the guide portion is disposed such that the sheet passes above the guide portion.

8. The image forming apparatus according to claim 1, further comprising a coupling portion configured to couple the guide portion and the second extending portion.

9. The image forming apparatus according to claim 1, wherein a gap is formed between the second extending portion and the guide portion.

10. The image forming apparatus according to claim 1, further comprising a guide member including the first extending portion, the second extending portion, a plurality of the guide portions, and an opening, wherein the opening communicates with a space formed by the first extending portion, the second extending portion, and the plurality of guide portions.

11. The image forming apparatus according to claim 1, further comprising a third extending portion, wherein the third extending portion extends from a downstream side to an upstream side of the heating portion in the conveyance direction and an end of the third extending portion is disposed upstream of the heating portion in the conveyance direction.

12. The image forming apparatus according to claim 11, wherein the image forming unit includes a photosensitive drum, and wherein the end of the third extending portion is located above the photosensitive drum and a position of the end of the third extending portion and a position of the photosensitive drum overlap each other in the horizontal direction.

13. The image forming apparatus according to claim 1, wherein the guide portion is configured to be opposed to a heated surface of the sheet to be brought into contact with the heating portion.

14. The image forming apparatus according to claim 1, wherein the guide portion has a plate-shape that extends in a direction crossing a width direction.

15. A sheet conveyance apparatus to convey a sheet such that the sheet passes through a fixing portion including a heating portion, the sheet conveyance apparatus comprising:

a conveyance portion configured to convey the sheet;

a guide portion configured to guide the sheet, wherein the guide portion faces a conveyance path through which the sheet passes, and the guide portion is disposed above the heating portion and is disposed at a downstream side of the fixing portion in a conveyance direction of the sheet;

a first extending portion extending in a direction crossing a vertical direction, wherein the first extending portion is disposed upstream of the guide portion and is disposed at the downstream side of the fixing portion in the conveyance direction; and a second extending portion extending from the first extending portion to a downstream side of the first extending portion in the conveyance direction, wherein, in a direction crossing the conveyance direction, the guide portion is disposed at one side of the conveyance path and the second extending portion is disposed to project more than the guide portion from the one side of the conveyance path to another side of the conveyance path, wherein, in a horizontal direction, the first extending portion is disposed to project more than the guide portion from the one side of the conveyance path to the other side of the conveyance path, and wherein, in the horizontal direction, the second extending portion is disposed to project more than the guide portion from the one side of the conveyance path to the other side of the conveyance path.

16. An image forming apparatus to form an image on a sheet using an image forming unit, the image forming apparatus comprising:

a conveyance portion configured to convey the sheet;

a fixing portion including a heating portion configured to heat the sheet;

a guide portion configured to guide the sheet, wherein the guide portion faces a conveyance path through which the sheet passes, and the guide portion is disposed above the heating portion and is disposed at a downstream side of the fixing portion in a conveyance direction of the sheet;

a first extending portion extending in a direction crossing a vertical direction, wherein the first extending portion is disposed upstream of the guide portion and is disposed at the downstream side of the fixing portion in the conveyance direction; and a second extending portion extending from the first extending portion to a downstream side of the first extending portion in the conveyance direction, wherein, in a direction crossing the conveyance direction, the guide portion is disposed at one side of the conveyance path and the second extending portion is disposed to project more than the guide portion from the one side of the conveyance path to another side of the conveyance path, wherein the first extending portion is configured to receive a water drop falling down from the guide portion and the second extending portion includes a regulation surface configured to regulate a movement of the water drop received by the first extending portion, and wherein the regulation surface faces an opposite side of the conveyance path in the direction crossing the conveyance direction.

17. The image forming apparatus according to claim 16, wherein, in the vertical direction, the first extending portion is disposed below the guide portion.

18. The image forming apparatus according to claim 17, wherein, in the vertical direction, the second extending portion extends upward from the first extending portion.

19. The image forming apparatus according to claim 16, wherein, in the direction crossing the vertical direction, the first extending portion is disposed to project more than the guide portion from the one side of the conveyance path to the other side of the conveyance path, and wherein, in the direction crossing the vertical direction, the second extending portion is disposed to project more than the guide portion from the one side of the conveyance path to the other side of the conveyance path.

20. The image forming apparatus according to claim 16, further comprising a third extending portion, wherein the image forming unit includes a photosensitive drum, wherein the third extending portion extends from a downstream side to an upstream side of the heating portion in the conveyance direction and an end of the third extending portion is disposed upstream of the heating portion in the conveyance direction, and wherein the end of the third extending portion is located above the photosensitive drum, and a position of the end of the third extending portion and a position of the photosensitive drum overlap each other in a horizontal direction.

* * * * *